US009661959B2

(12) United States Patent
Prior

(10) Patent No.: US 9,661,959 B2
(45) Date of Patent: May 30, 2017

(54) TOILET PAPER HOLDING DEVICE

(71) Applicant: Gary Prior, Garner, NC (US)

(72) Inventor: Gary Prior, Garner, NC (US)

( * ) Notice: Subject to any disclaimer, the term of this patent is extended or adjusted under 35 U.S.C. 154(b) by 0 days.

(21) Appl. No.: 14/858,202

(22) Filed: Sep. 18, 2015

(65) Prior Publication Data

US 2017/0027395 A1 Feb. 2, 2017

Related U.S. Application Data

(60) Provisional application No. 62/198,344, filed on Jul. 29, 2015.

(51) Int. Cl.

| | |
|---|---|
| ***B65H 16/04*** | (2006.01) |
| ***A47K 10/40*** | (2006.01) |
| ***A47K 10/38*** | (2006.01) |

(52) U.S. Cl.

CPC ..... *A47K 10/40* (2013.01); *A47K 10/3836* (2013.01)

(58) Field of Classification Search

CPC ..... A47K 10/24; A47K 10/32; A47K 10/38; A47K 10/40; A47K 2010/326; A47K 10/3836

See application file for complete search history.

(56) References Cited

U.S. PATENT DOCUMENTS 1,226,453 A 5/1917 Boyle
1,665,738 A 5/1925 Hoegger
1,614,112 A * 1/1927 Fisher ..... A47K 10/22 242/594.5
2,555,531 A * 6/1951 Boord ..... A47K 10/3836 211/59.1
3,049,310 A * 8/1962 Wolfe ..... A47K 10/38 242/594.6
3,079,099 A * 2/1963 Blain ..... A47K 10/3836 242/597.5
3,398,908 A * 8/1968 Thompson ..... A47K 10/3836 211/123
3,792,822 A * 2/1974 Underhill ..... A47K 10/3836 211/59.1
3,923,265 A * 12/1975 Krueger ..... A47K 10/40 242/578
4,553,711 A * 11/1985 Urion ..... A47K 10/3836 242/129.5
4,741,486 A 5/1988 Ancona et al.
4,767,074 A * 8/1988 Bower ..... A47K 10/3836 242/594.5
5,170,956 A 12/1992 McTaggart
(Continued)

*Primary Examiner* — William A Rivera
(74) *Attorney, Agent, or Firm* — Global Intellectual Property Agency, LLC; Daniel Boudwin

(57) ABSTRACT

A toilet paper holding device for efficiently storing toilet paper in an organized manner. The toilet paper holding device includes a baseplate that can be mounted to a wall or other support surface via one or more fasteners, such as screws. The baseplate includes one or more telescopic arms extending therefrom. The telescopic arms can be extended or retracted in length so as to hold a desired number of toilet paper rolls thereon. In embodiments having several arms, the arms are substantially parallel to one another and are separated by a space. The telescopic arms can be removably secured to the baseplate via a threaded connection. In this way, the toilet paper holding device allows a user to store a number of toilet paper rolls in an organized manner.

3 Claims, 3 Drawing Sheets

(56) References Cited

U.S. PATENT DOCUMENTS

| | | | | |
|---|---|---|---|---|
| D343,110 | S * | 1/1994 | Smirne | D8/358 |
| 5,871,170 | A * | 2/1999 | Morales | A47K 10/40 242/592 |
| 6,786,448 | B2 * | 9/2004 | Arcilesi | A47K 10/3836 242/597.4 |
| 2007/0215742 | A1 * | 9/2007 | Zollinger | B65H 49/16 242/558 |

* cited by examiner

TOILET PAPER HOLDING DEVICE

CROSS REFERENCE TO RELATED APPLICATION

This application claims the benefit of U.S. Provisional Application No. 62/198,344 filed on Jul. 29, 2015. The above identified patent application is herein incorporated by reference in its entirety to provide continuity of disclosure.

BACKGROUND OF THE INVENTION

Field of the Invention

The present invention relates to toilet paper holding devices. More specifically, the present invention provides an adjustable toilet paper holding device that can be mounted on a wall or other support surface. The toilet paper holding device further includes one or more telescopic arms that can be adjusted to a desired length for holding a number of toilet paper rolls thereon.

Toilet paper often consumes substantial space within a storage area, such as a closet or pantry. The toilet paper rolls are placed on the floor or on a shelf, and are arranged in one or more stacks. However, by placing the toilet paper on the shelf, the shelf cannot be used to store other items. If toilet paper rolls are placed on the floor, the toilet paper may become dirty or wet, rendering the toilet paper unusable. Further, the toilet paper rolls may be difficult to retrieve, and the stacks can easily be knocked over, creating a mess. While some toilet paper roll holders exist in the prior art, many such devices are a fixed size, and may be too large and thus consume too much space within a storage area. Further, such devices may not be the correct size or shape so as to fit within various storage areas and such devices cannot be adjusted in size. Thus, an adjustable toilet paper holding device that can be secured to a wall or other support surface so as to make efficient use of storage space is desired.

Devices have been disclosed in the prior art that relate to toilet paper holding devices. These include devices that have been patented and published in patent application publications. These devices generally relate to toilet paper or paper towel holders, such as U.S. Pat. No. 5,871,170, U.S. Pat. No. 4,741,486, U.S. Pat. No. 1,665,738, U.S. Pat. No. 5,170,956, and U.S. Pat. No. 1,226,453.

These prior art devices have several known drawbacks. Some devices are adapted for holding a single roll of toilet paper for use thereof, and do not provide toilet paper storage devices suited for storing a plurality of toilet paper rolls. Further, many devices include a hinge or joint, but fail to disclose a telescopic arm that can be extended or retracted in length.

In light of the devices disclosed in the prior art, it is submitted that the present invention substantially diverges in design elements from the prior art and consequently it is clear that there is a need in the art for an improvement to existing toilet paper holding devices. In this regard the instant invention substantially fulfills these needs.

SUMMARY OF THE INVENTION

In view of the foregoing disadvantages inherent in the known types of toilet paper holding devices now present in the prior art, the present invention provides a new toilet paper holding device wherein the same can be utilized for providing convenience for the user when storing multiple rolls of toilet paper in an organized manner.

It is therefore an object of the present invention to provide a new and improved toilet paper holding device comprising a baseplate adapted to be mounted to a support surface, such as a wall, wherein one or more arms extend outward from the baseplate and are adapted to receive toilet paper rolls thereon.

It is another object of the present invention to provide a toilet paper holding device comprising one or more telescopic arms that can be adjusted in length so as to hold a desired number of toilet paper rolls thereon.

Another object of the present invention is to provide a toilet paper holding device having one or more arms that are removably securable to the baseplate.

Yet another object of the present invention is to provide a toilet paper holding device having a baseplate that can be secured to a support surface using any of various fasteners, such as screws, among others.

Another object of the present invention is to provide a toilet paper holding device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
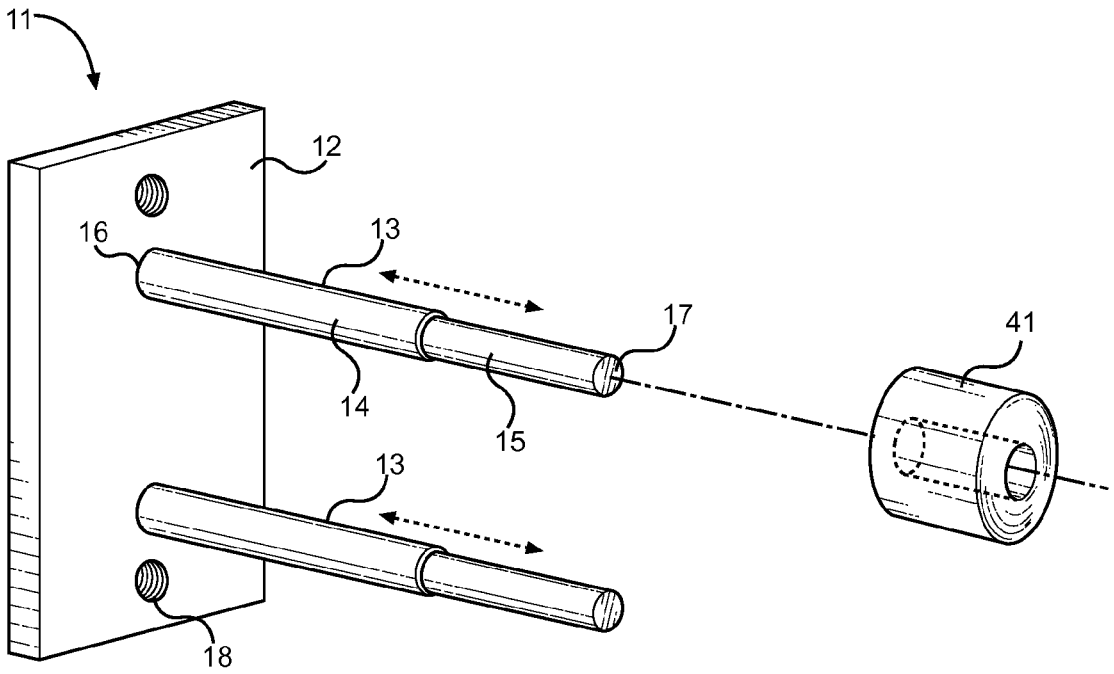
FIG. 1 shows a perspective view of the adjustable toilet paper holding device.

Reference is made herein to the attached drawings. Like reference numerals are used throughout the drawings to depict like or similar elements of the adjustable toilet paper holding device. For the purposes of presenting a brief and clear description of the present invention, the preferred embodiment will be discussed as used for holding multiple rolls of toilet paper in an organized and efficient manner. The figures are intended for representative purposes only and should not be considered to be limiting in any respect.

Referring now to FIG. 1, there is shown a perspective view of the toilet paper holding device. The toilet paper holding device 11 comprises a baseplate 12 adapted to be mounted to a support surface, such as a wall, a door, a column, or the interior of a cabinet, among others. The baseplate 12 preferably comprises a flat surface that can be placed flush against the support surface. In the illustrated embodiment, the baseplate 12 comprises a rectangular configuration, however, in alternate configurations the baseplate 12 can have any of various shapes.

The baseplate 12 comprises one or more apertures 18 therethrough, wherein the apertures 18 are adapted to receive fasteners for securing the baseplate 12 to a support surface. Preferably, the apertures 18 comprise threading so that a threaded fastener, such as a screw can be inserted through the apertures 18 and into the support surface so as to affix the baseplate 12 to the support surface. The apertures 18 can be variously arranged on the baseplate 12 and can be disposed about the perimeter thereof, on the corners thereof, or in various other configurations.

The toilet paper holding device 11 further comprises one or more arms 13 having a first end 16 and a second end 17, wherein the first end 16 is secured to the baseplate 12. The arms 13 are substantially perpendicular to the baseplate 12. The arms 13 are preferably linear in configuration, and in the illustrated embodiment the arms 13 are shown as having a cylindrical shape, however, in alternate embodiments, the arms 13 can have other configurations. The arms 13 are configured so that a toilet paper roll 41 can be positioned on each arm 13 by inserting the second end 17 of the arm 13 through the central opening of the roll of toilet paper roll 41. Thus, each arm 13 is adapted to extend through the hollow interior portion of the toilet paper roll 41. The arms 13 are adjustable and include one or more telescoping sections 14, 15.

In embodiments having two or more arms 13, the arms 13 are separated by a fixed distance so that toilet paper rolls 41 positioned on each arm 13 do not interfere with one another. Further, the arms 13 are preferably parallel to one another. The arms 13 can be arranged in a straight line such that the arms 13 are either aligned, such as vertically aligned, or can be affixed to various portions of the baseplate 12. In the illustrated embodiment, the arms 13 are shown as being vertically aligned.

Figure 2:
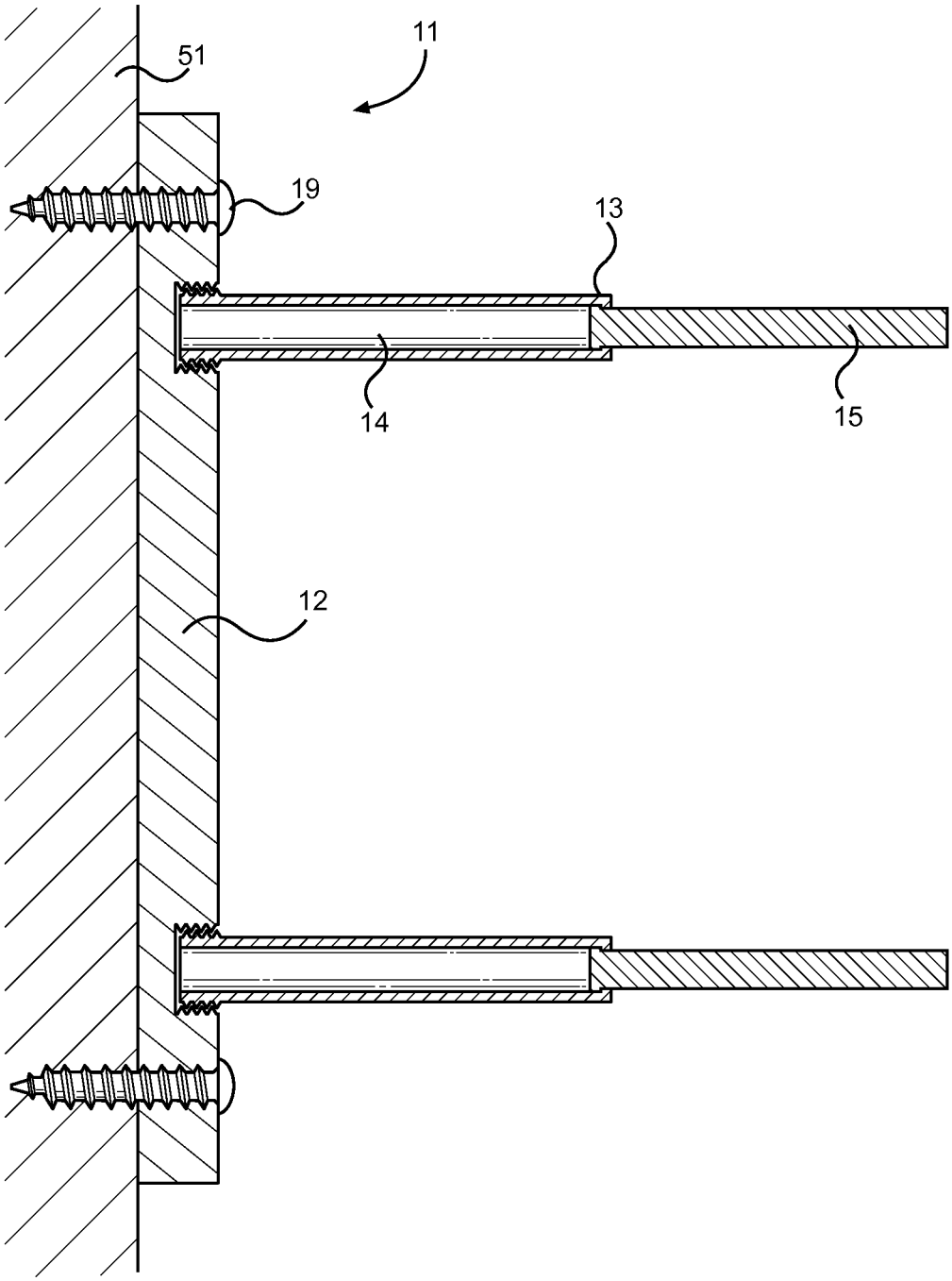
FIG. 2 shows a side cross sectional view of the adjustable toilet paper holding device.

Referring now to FIG. 2, there is shown a side cross sectional view of the adjustable toilet paper holding device. The baseplate 12 is affixed to a support surface 51 via one or more fasteners 19 inserted through the apertures on the baseplate 12. The arms 13 are positioned substantially horizontally so that one or more toilet paper rolls can be positioned thereon.

The arms 13 are telescopic and include a plurality of adjustable sections. Preferably, the adjustable sections are tubular in configuration and include a hollow interior volume. In the illustrated embodiment, the arms 13 are shown as having a first section 14 and a second section 15. However, in alternate embodiments, the arms 13 can have additional sliding sections so as to allow the arms 13 to be extended to a greater extent or retracted to a more compact length. The second section 15 is movably positioned within the interior volume of the first section 14 and can be extended outward therefrom or retracted into the first section 14. In this way, the arm 13 can be extended so as to hold additional toilet paper rolls thereon, or can be shortened so as to hold fewer rolls. This helps the toilet paper holder 11 to fit within various storage areas and further allows a user to store various numbers of toilet paper rolls thereon. Preferably, the arms 13 include means for preventing the first and second sections 14, 15 from separating from one another, such as a stopper or locking mechanism disposed on one or more of the sections 14, 15.

Figure 3:
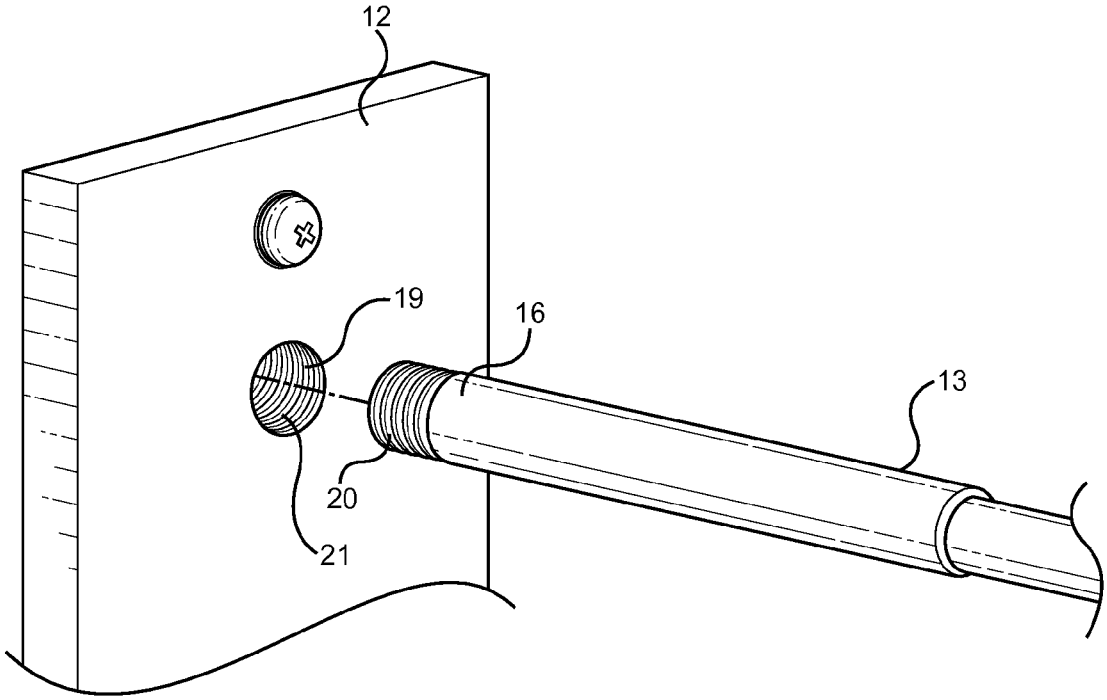
FIG. 3 shows a close-up view of an arm as positioned for insertion into the baseplate of the adjustable toilet paper holding device.

Referring now to FIG. 3, there is shown a close-up view of an arm as positioned for insertion into the baseplate of the adjustable toilet paper holding device. In some embodiments, the arms 13 are removably securable to the baseplate 12 so that the user can select the number of arms 13 on the baseplate 12. The first end 16 of the arm 13 is removably connected to the baseplate 12. In the illustrated embodiment, the first end 16 of the arm 13 includes threading 20 on the exterior thereof adapted to engage with internal threading 21 on an opening 19 on the baseplate 12 in order to removably secure the arm 13 to the baseplate 12. In alternate embodiments, other fastening arrangements are provided, such as a frictional or press fit, or mating fasteners.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper holding device, comprising:

a planar baseplate including a plurality of threaded openings and a plurality of apertures configured to receive fasteners therethrough;

a plurality of telescopic arms removably securable to the baseplate, the plurality of telescopic arms including a first end and a second end, the first end including threading configured to threadably engage one of the plurality of threaded openings for removably securing the plurality of telescopic arms to the baseplate;

the plurality of telescopic arms including a first section having a hollow interior volume and a second section, the second section slidably disposed within the hollow interior volume of the first section, thereby forming a telescopic arrangement wherein the second section is configured to retract into the first section forming a retracted configuration and extend out of the first section forming an extended configuration;

wherein the plurality of telescopic arms extend perpendicularly, outwardly relative to the baseplate when secured thereto.

2. The toilet paper of holding device of claim 1, wherein in the retracted configuration, the plurality of telescopic arms include a length sized to receive a toilet paper roll thereon and wherein in the extended configuration, the plurality of telescopic arms include a length sized to receive more than one toilet paper roll thereon.

3. The toilet paper holding device of claim 1, wherein the plurality of arms include at least a first telescopic arm and a second telescopic arm, wherein the first and second telescopic arms are vertically aligned and extend from the baseplate parallelly relative to one another.

* * * * *